US006325661B1

(12) United States Patent
Tabata

(10) Patent No.: US 6,325,661 B1
(45) Date of Patent: Dec. 4, 2001

(54) WATERPROOF CONNECTOR

(75) Inventor: Masaaki Tabata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/524,806

(22) Filed: Mar. 14, 2000

(30) Foreign Application Priority Data

Mar. 18, 1999 (JP) ..... 11-074182

(51) Int. Cl.[7] ..... H01R 13/58; H01R 13/40; H01R 13/73; H01R 9/22

(52) U.S. Cl. ..... 439/459; 439/587; 439/936

(58) Field of Search ..... 439/459, 587, 439/456, 276, 275, 279, 936

(56) References Cited

U.S. PATENT DOCUMENTS 4,863,177 * 9/1989 Rockwood et al. ..... 277/199
4,869,686 * 9/1989 Michaels et al. ..... 439/455
5,145,402 9/1992 Plyler et al. ..... 439/459
5,667,406 * 9/1997 Tabata et al. ..... 439/587
5,931,699 * 8/1999 Saito ..... 439/587
6,039,603 * 3/2000 Wakata et al. ..... 439/587

* cited by examiner

*Primary Examiner*—Tulsidas Patel
*Assistant Examiner*—Chandrika Prasad
(74) *Attorney, Agent, or Firm*—Anthony J. Casella; Gerald E. Hespos

(57) ABSTRACT

A connector is provided that is short in a length from a front end thereof to an electric wire-bending portion thereof. An electric wire (45) extends rearward from a cavity (13) in a housing (11), and is bent downward and led to the outside from an electric wire lead-out opening (25). At the electric wire lead-out opening (25), the periphery of the electric wire (45) is sealed with a rubber plug (50). The gap between an open edge portion (19) of a housing (11) and a cover (30) is sealed with a sealing member (55) made of a jelly-like material. Thus, it is unnecessary to provide a rear part of the cavity (13) with a portion for installing a rubber plug thereon. Therefore, it is possible to provide the connector short in the length from the front end thereof to the electric wire-bending portion thereof.

12 Claims, 7 Drawing Sheets

WATERPROOF CONNECTOR

BACKGROUND OF THE INVENTION

1. Field of the Invention

The present invention relates to a waterproof connector.

2. Description of the Related Art

A prior art waterproof connector is identified generally by the numeral 1 in FIGS. 7 and 8. The connector 1 has a terminal fixture 3 connected with an electric wire 2. The connector 1 also has a housing 5 with a cavity 4 configured for accommodating the terminal fixture 3. A cover 6 is installed on a rear end portion of the housing 5, and is configured to enable a bend of the electric wire 2. An insulation barrel 3A is provided at a rear end portion of the terminal fixture 3 to fixedly crimp a rubber plug 7 into which the electric wire 2 has been inserted. The rubber plug 7 is in close contact with an inner peripheral wall of the cavity 4 and with the electric wire 2 to waterproof each cavity 4.

The cover 6 is constructed of a pair of half covers 6A and 6B that are butted to each other. An electric wire lead-out opening 8 is formed on an end surface of each of the half covers 6A and 6B. The electric wire 2 is taken out to the exterior through the electric wire lead-out opening when both half covers 6A and 6B are bought into contact with each other.

The prior art connector 1 has a length A from the front end of the connector 1 to an electric wire-bending portion. This length A is required to be as small as possible because of a limited space. However, the conventional waterproof connector is constructed so that the electric wire 2 is sealed with the rubber plug 7 that extends rearward from the rear end portion of the terminal fixture 3. Thus the prior art housing 5 must be long enough to incorporate the rubber plug 7 in the rear part of the cavity 4. Further, the electric wire 2 is bent at a position rearward of the rubber plug 7. Thus, the prior art construction prevents the length A from being reduced.

SUMMARY OF THE INVENTION

The present invention has been made in view of the above-described situation. It is an object of the present invention to provide a connector that has a short length from a front end to an electric wire-bending portion thereof.

A connector in accordance with the invention comprises a terminal fixture that has opposed ends. One end of the terminal fixture is a connection portion that can be connected to one end of an electric wire. The opposed end of the terminal fixture is configured to be connected with a terminal of a mating connector.

The connector also comprises a housing with opposite front and rear ends. The housing has a cavity that is open at front end of the housing and at the rear end thereof. The cavity is capable of accommodating the terminal fixture.

A cover is installed on the housing and covers a draw-out portion of the electric wire. The cover guides the electric wire that is led out from the cavity through an electric wire lead-out opening, such that the electric wire is bent sideways. A sealing member is provided for sealing a gap between the cover and the housing. Furthermore, a rubber plug is installed on the electric wire and seals a periphery of the electric wire at the electric wire lead-out opening. The rubber plug may be fixed to the connection portion.

According to the invention, the gap between the housing and the cover is sealed with the sealing member, and the periphery of the electric wire at the electric wire draw-out portion is sealed with the rubber plug. Thus, it is unnecessary to provide a rear part of the cavity with a part for installing the rubber plug thereon. Accordingly, it is possible to bend the electric wire at the rear end of the terminal fixture and thus reduce the length from the front end of the connector to the electric wire-bending portion.

Further, according to the invention, the rubber plug is easy to place in position.

DETAILED DESCRIPTION OF THE PREFERRED EMBODIMENTS

An embodiment of the present invention will be described below with reference to FIGS. 1 through 6.

Figure 1:
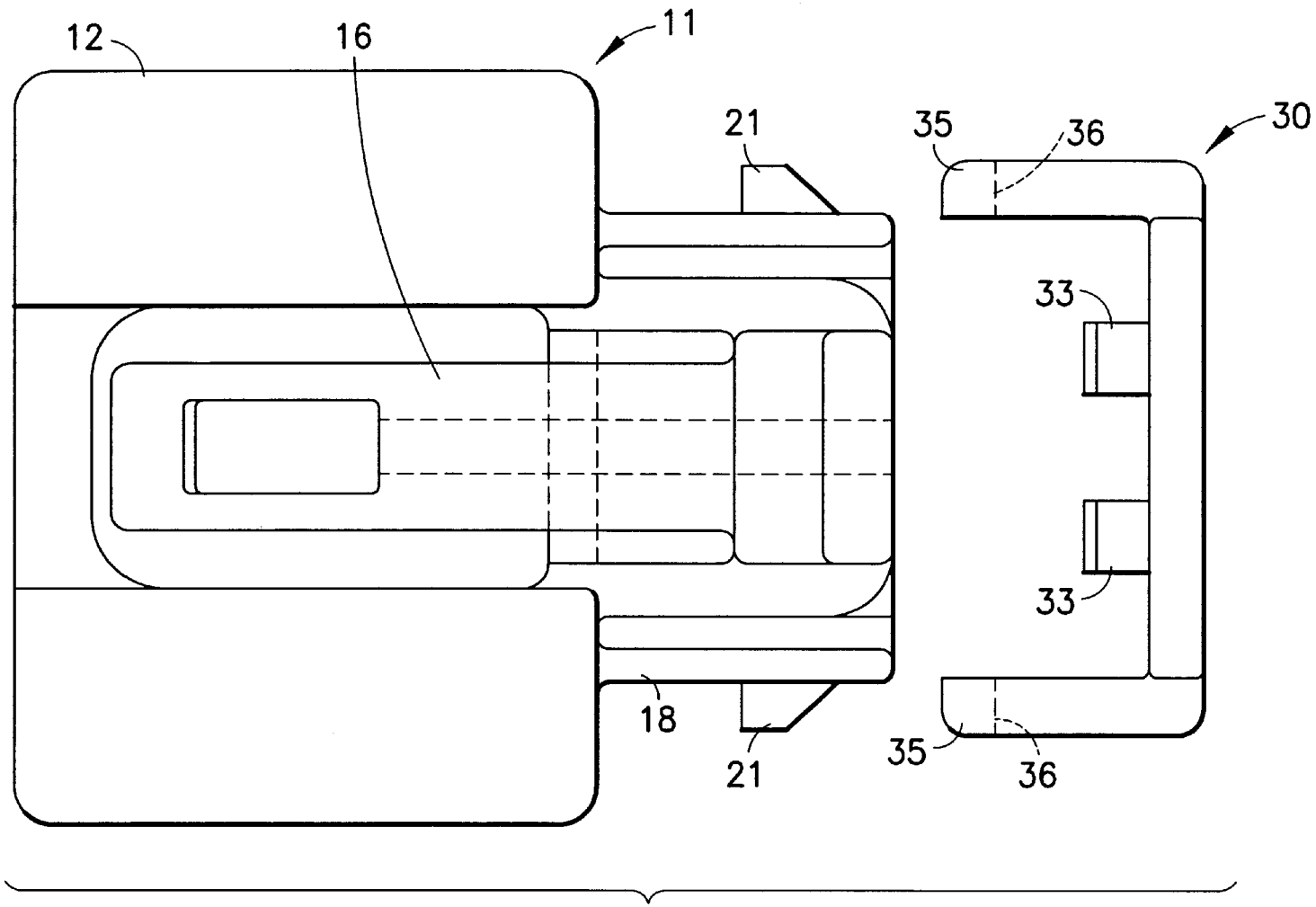
FIG. 1 is a plan view showing a connector of an embodiment of the present invention.
Figure 2:
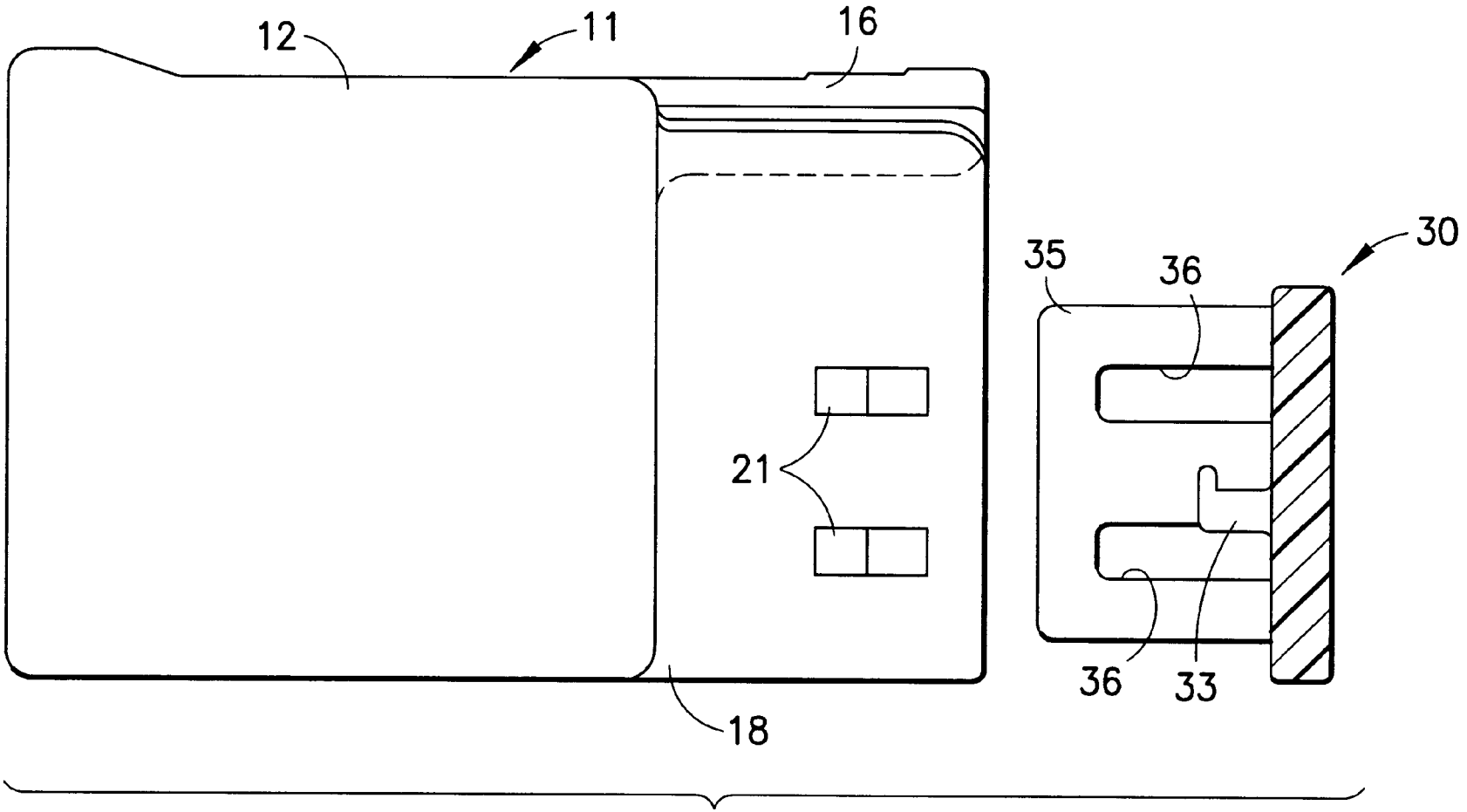
FIG. 2 is a side view and a sectional side elevation showing the connector and a cover, respectively.
Figure 3:
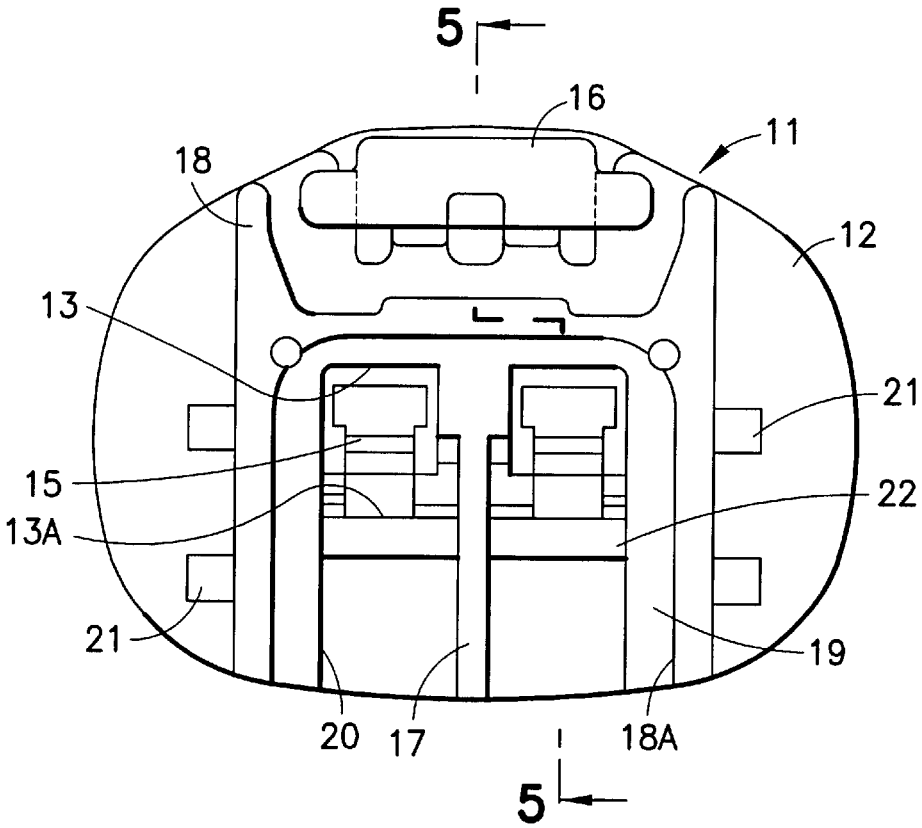
FIG. 3 is a rear view showing a housing.
Figure 4:
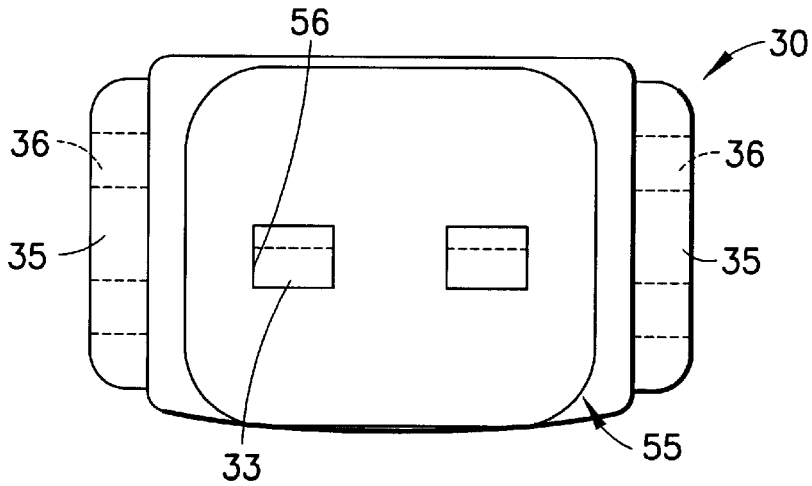
FIG. 4 is a front view showing the cover.
Figure 5:
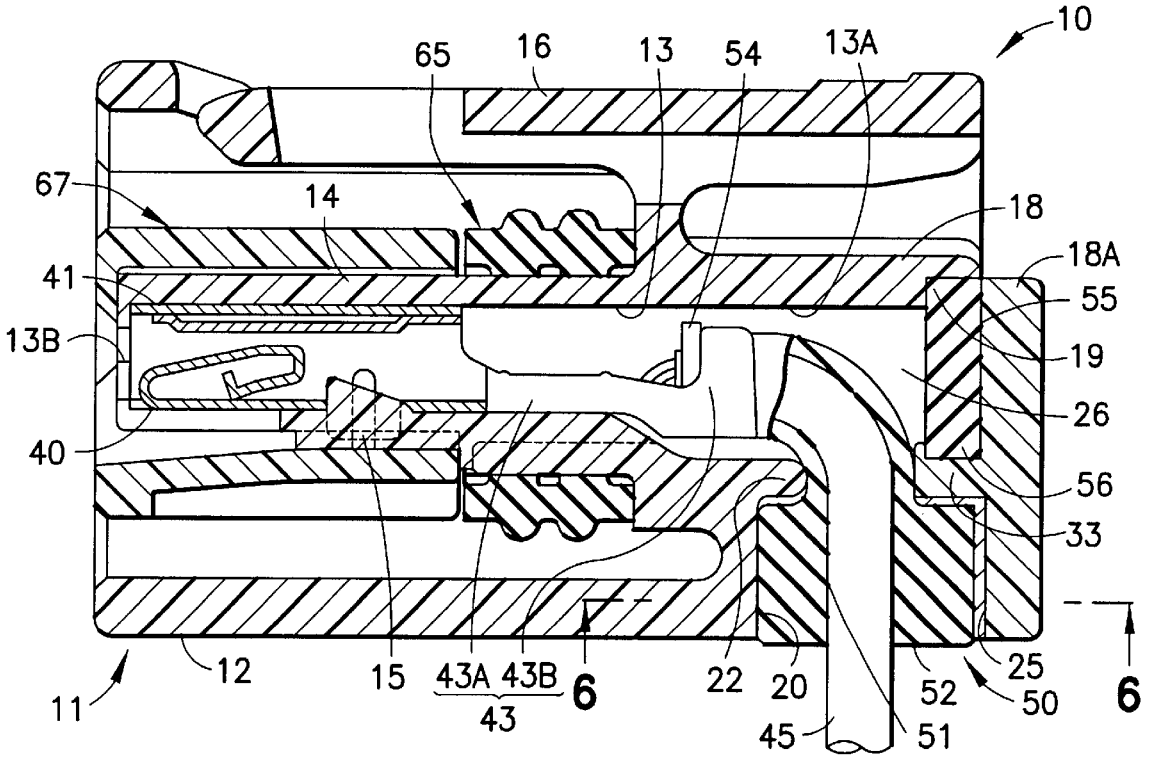
FIG. 5 is a cross-sectional view taken along line 5—5 in FIG. 3.

As shown in FIG. 5, a connector 10 has a pair of female-side terminal fixtures 40 connected with an electric wire 45. The connector 10 further comprises a housing 11 that accommodates the female-side terminal fixtures 40, and a cover 30 which can be installed on a rear portion of the housing 11.

The housing 11 is unitarily molded of a synthetic resinous material, and has opposite front and rear sides. The front side of the housing 11 is formed to define a hood 12 into which a male-side connector (not shown) can be inserted. A locking arm 16 is provided on an upper surface of the housing 11, and is deformable with the motion of a seesaw. The locking arm 16 engages a part of the male-side connector, and holds the male-side connector in an unremovable state.

The housing 11 is molded to define a pair of right and left cavities 13, each of which is capable of accommodating one of the female-side terminal fixtures 40. A peripheral wall of each cavity 13 projects into the hood 12, and thus forms a projecting portion 14. Each cavity 13 is open at its rear and at its front. The open rear of each cavity 13 defines a terminal insertion opening 13A into which one of the female-side terminal fixtures 40 can be inserted. The open front of each cavity 13 defines a tab insertion opening 13B for receiving a tab (not shown) of the male-side connector. A vertically deformable lance 15 projects from a bottom wall of the cavity 13. The lance 15 elastically engages the female-side terminal fixture 40, and prevents the female-side terminal fixture 40 from being removed from the cavity 13.

A rubber ring 65 can be mounted on a peripheral surface of the projecting portion 14 at its rear side. The rubber ring 65 has several convexities on its inner and outer peripheral surfaces. The convexities contact the housing 11 and the male-side connector closely, thus sealing the gap present therebetween. A cylindrical retainer 67 is provided on the peripheral surface of the front side of the projecting portion 14, and has an engaging means that engages the projecting portion 14. The retainer 67 restricts deflection of the lance 15, thus unremovably holding the female-side terminal fixture 40 in the cavity 13.

Figure 6:
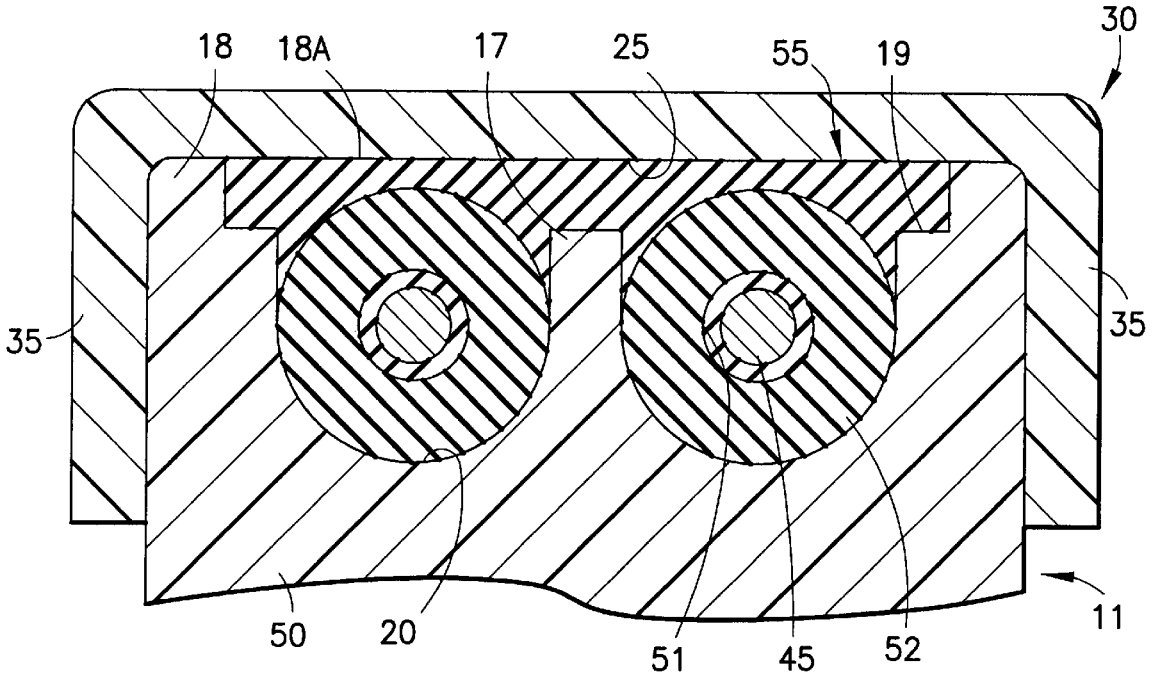
FIG. 6 is a cross-sectional view taken along line 6—6 in FIG. 5.
Figure 7:
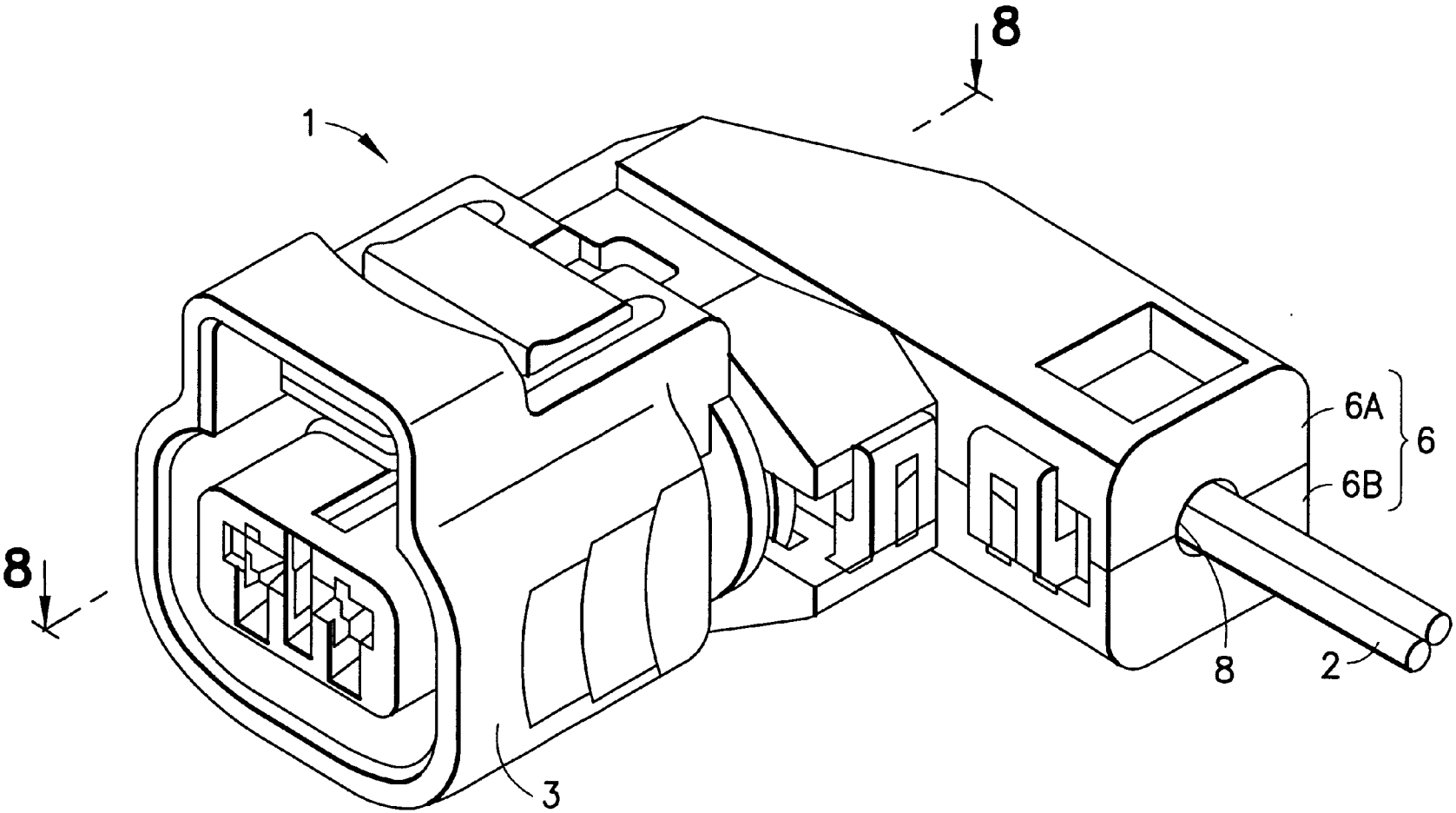
FIG. 7 PRIOR ART
FIG. 7 is a perspective view showing a conventional connector.
Figure 8:
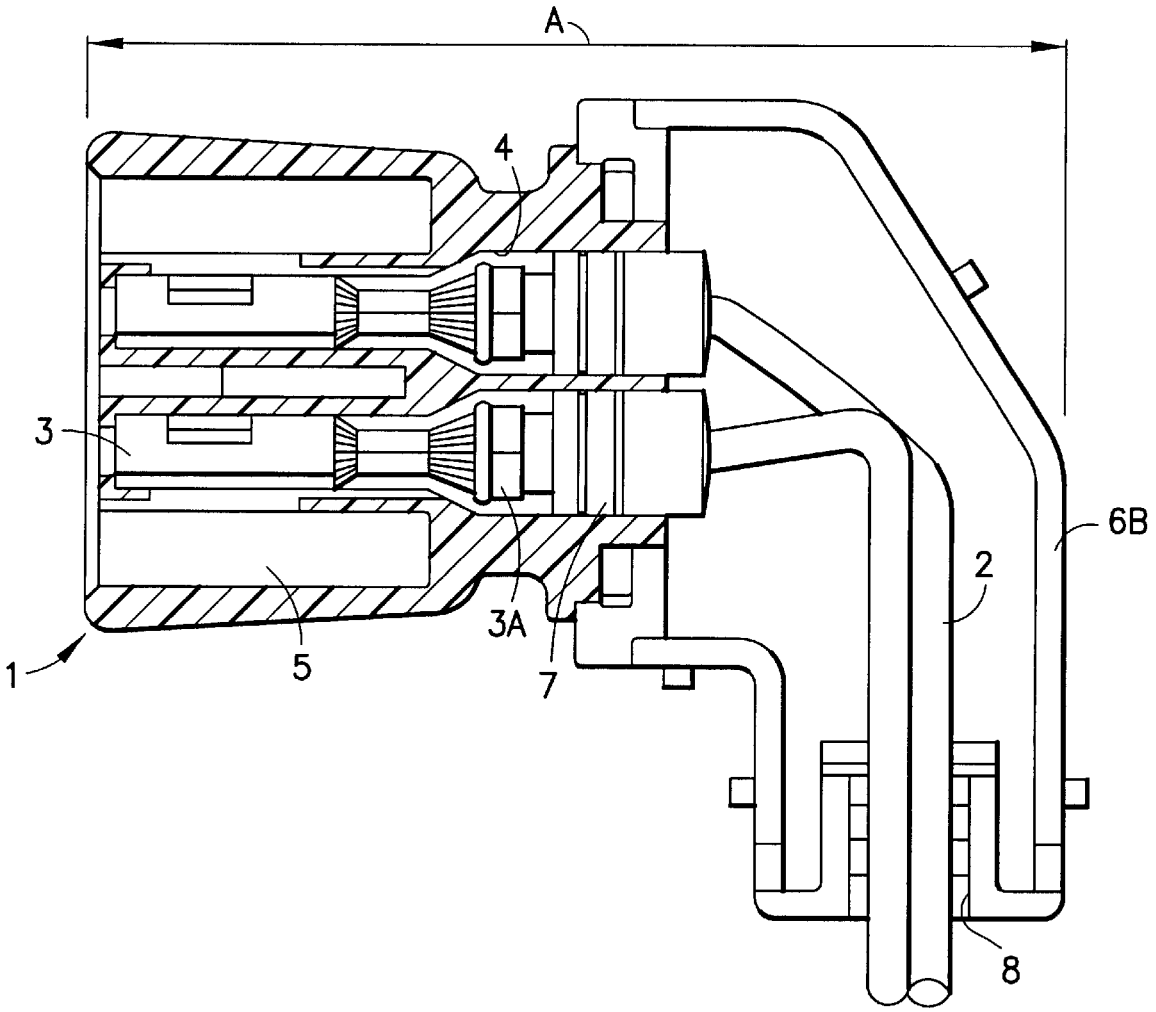
FIG.8 PRIOR ART
FIG. 8 is a cross-sectional view taken along line 8—8 in FIG. 7.

An H-shaped rear wall 18 projects from the rear of the housing 11. A lower portion of the rear wall 18 is formed with a rear opening 18A that can be covered with the cover 30. The rear wall 18 has an open edge 19 that is recessed along a U-shaped edge of the rear opening 18A such that the open edge 19 and the U-shaped edge have a difference in level. A sealing member 55, which will be described later, is disposed inside the open edge portion 19 when the cover is installed on the rear opening 18A. The space rearward from the terminal insertion opening 13A is divided right and left with a partitioning wall 17 to form a wire-bending space 26. The electric wire 45 that extends from the terminal insertion opening 13A can be bent downward in the wire-bending space 26. The housing 10 has a U-shaped groove part 20 formed concavely at a lower side of each wire-bending space 26, as shown in FIG. 6. When the cover 30 is installed on the rear opening 18A, an electric wire lead-out opening 25 is formed between a wall surface of the groove part 20 and the cover 30. The electric wire 45 is bent through the electric wire lead-out opening 25, and is guided to the outside of the connector 10. The electric wire 45 is fitted into a sealing portion 52 of a rubber plug 50, and the rubber plug 50 then can be installed on the groove part 20. A projecting portion 22 is formed between the groove part 20 and the terminal insertion opening 13A, and sets a vertical position of the sealing portion 52.

A pair of locking projections 21 are formed vertically on each of left and right outer side surfaces of the rear wall 18 of the housing 11 for installing the cover on the housing 11.

The cover 30 is unitarily molded from a synthetic resinous material into a flat shape that is large enough to cover the rear opening 18A. Elastic locking arms 35 extend forwardly from the respective left and right side edges of the cover 30. Each locking arm 35 is formed with a locking hole 36 which is disposed and dimensioned to receive one of the locking projections 21 therein when the cover 30 is installed on the housing 11.

The cover 30 has a pair of hook-shaped sealing member-holding portions 33 that project from positions that confront the projecting portion 22 of the housing 11. Each sealing member-holding portion 33 penetrates through the sealing member 55, and hooks the sealing member 55. The electric wire 45 can be sandwiched between the tip of the sealing member-holding portions 33 and the projecting portion 22 through the rubber plug 50.

The sealing member 55 is made of a jelly-like material and has an approximately square plate with a size that corresponds to the size of the open edge 19. The sealing member 55 has a pair of fit-in holes 56, and each sealing member-holding portion 33 can be fitted into one of the fit-in holes 56.

The female-side terminal fixture 40 has a front end that defines a square pillar-shaped coupling portion 41. The coupling portion 41 can be coupled to the tab of the male-side connector. The lance 15 in the cavity 13 of the housing 11 can engage the coupling portion 41 of the female-side terminal fitting 40. A connection portion 43 is formed at the rear end portion of the female-side terminal fixture 40. The connection portion 43 has a pair of wire barrels 43A and a pair of insulation barrels 43B. Each wire barrel 43A and each insulation barrel 43B consists of a crimping piece. A core wire of the electric wire 45 can be connected with the wire barrel 43A by crimping. Similarly, the electric wire 45 and the rubber plug 50 to be installed on the periphery thereof are fixed to the insulation barrel 43B by crimping.

When the female-side terminal fixture 40 is accommodated inside the cavity 13, the rear edge of the connection portion 43 is coincident with the terminal insertion opening 13A. Thus, the electric wire 45 connected with the connection portion 43 is drawn to the outside from the cavity 13, and is bent immediately in the wire-bending space 26 located at a rearward position of the housing 11.

The rubber plug 50 is unitarily molded into a cylindrical shape from a rubber material that has a proper degree of elasticity. A through-hole 51 is formed along the axis of the rubber plug 50 for receiving the electric wire. A sealing portion 52 for sealing the periphery of the electric wire lead-out opening 25 is provided at one end of the peripheral surface of the through-hole 51. The outer diameter of the sealing portion 52 is a little larger than the inner diameter of a sectionally circular arc-shaped portion of the groove 20. Thus the sealing portion 52 can be brought into close contact with the circular arc-shaped portion of the groove 20 (see FIG. 6). A portion of the rubber plug 50 forwardly of the sealing portion 52 has a sufficiently small-diameter to be bent with the electric wire 45 inserted through the through-hole 51. The rubber plug 50 has an edge 54 which projects outside to a small extent. The rubber plug 50 can be fixed to the female-side terminal fixture 40 at an appropriate position by crimping a portion of the rubber plug 50 immediately inwardly (rearward) from the edge 54 with the insulation barrel 43B.

The connector 10 of this embodiment is assembled by initially inserting an end of the bare electric wire 45 into the through-hole 51 from an opening of the rubber plug 50 at the side of the sealing portion 52. The end of the electric wire 45 then is taken out from an opposite-side opening of the rubber plug 50. Then, the core wire of the electric wire 45 is connected with the female-side terminal fixture 40 by crimping the electric wire 45 with the wire barrel 43A of the female-side terminal fixture 40. The electric wire 45 inside the rubber plug 50 and the portion of the rubber plug 50 immediately inward from the edge 54 then are fixed to the female-side terminal fixture 40 with the insulation barrel 43B. The rubber plug 50 is fixed to the connection portion 43 of the female-side terminal fixture 40 in this manner. Thus, the rubber plug 50 can be easily fixed to the female-side terminal fixture 40 at a predetermined position.

After the electric wire 45 and the rubber plug 50 are fixed to the female-side terminal fixture 40 in this manner, the female-side terminal fixture 40 is inserted into the cavity 13 from the terminal insertion opening 13A. Sufficient insertion of the female-side terminal fixture 40 into the cavity 13 enables the lance 15 to engage the female-side terminal fixture 40. Thus, the female-side terminal fixture 40 is prevented from being removed from the cavity 13. The rubber ring 65 is mounted on the periphery of the projecting portion 14, and the projecting portion 14 is engaged by the retainer 67 to hold the female-side terminal fixture 40 in an unremovable state. Assembly continues by fitting the sealing member-holding portion 33 of the cover 30 into the fit-in hole 56 to hold the sealing member 55 therein.

The electric wire 45 that extends from the terminal insertion opening 13A and portions of the rubber plug 50 mounted on the electric wire 45 are bent downward in the wire-bending space 26. The sealing portion 52 then is inserted into the groove 20. Then, the cover 30 is pressed against the rear portion of the housing 11 such that the cover 30 covers the rear opening 18A. As a result, the sealing member 55 is sandwiched between the open edge 19 and the cover 30, thus closing the gap therebetween. Further, the rear end of the sealing portion 52 is pressed against the sealing member 55. Consequently, the sealing member 55 penetrates into the gap between the sealing portion 52 and the wall surface of the groove part 20, thus sealing the periphery of the electric wire lead-out opening 25 completely. When the cover 30 is pressed to the predetermined position, the locking projection portion 21 is fitted into the locking hole 36. In this manner, the assembling of the connector 10 is completed.

As described above, according to the embodiment, the gap between the open edge portion 19 of the housing 11 and the cover 30 is sealed with the sealing member 55, and the periphery of the electric wire 45 at the electric wire lead-out opening 25 is sealed with the rubber plug 50. Thus, it is unnecessary to provide the rear part of the cavity 13 with a portion for installing the rubber plug thereon. Therefore, the electric wire 45 can be bent at the rear end of the female-side terminal fixture 40, and hence the length from the front end of the connector 10 to the electric wire-bending portion can be reduced.

Further, because the rubber plug 50 is fixed to the connection portion 43 of the female-side terminal fixture 40, the rubber plug 50 can be easily fixed in position. For example, supposing that the rubber plug is not fixed to the female-side terminal fixture 40, the installing position of the rubber plug on the electric wire 45 can be dislocated from its specified position. If the connector 10 is assembled in this state, the length of the bent portion of the electric wire 45 is not fixed. As a result, the electric wire 45 is stretched or bent excessively, which can cause the electric wire 45 to be broken or damaged. To avoid such a disadvantage, it is necessary to perform a complicated work of inserting the female-side terminal fixture 40 into the cavity 13 and installing the electric wire 45 on the groove 20 after the rubber plug is moved to an appropriate position by checking a bent state of the electric wire 45. But according to the above-described embodiment, because the rubber plug 50 is placed in an appropriate position, it is possible to accomplish the assembling work smoothly.

The present invention is not limited to the described embodiment. For example, embodiments described below are included in the technical scope of the present invention.

Although the sealing member 55 is made of a jelly-like material, it may be made of a rubber material.

Although the connector 10 of the embodiment is a female-side connector for accommodating the female-side terminal fixture 40, it may be applicable to a male-side connector for accommodating a male-side terminal fixture.

Although in the embodiment, the number of the female-side terminal fixtures 40 that is accommodated in the housing 11 and that of the electric wires 45 that are connected therewith are two, respectively, the number of each thereof is not limited to two.

Although in the embodiment, the electric wire lead-out opening 25 is formed between the groove part 20 of the housing 11 and the cover 30, the electric wire lead-out opening 25 may be formed in penetration through the cover 30.

Although in the embodiment, the groove part 20 of the housing 11 and the cover 30 are separate from each other, both may be formed integrally with each other through a hinge or the like.

What is claimed is:

1. A connector comprising:

a housing with opposite front and rear sides, a wire bending space defined by a plurality of interconnected walls extending forwardly from the rear side, a cavity extending through the housing and being open at the front side and at the wire bending space, one of the interconnected walls having a groove aligned transverse to the cavity;

a terminal fixture with opposite front and rear ends, the front end being configured for connection with a terminal of a mating connector, the rear end being fixed to an end of an electric wire, the terminal fixture being accommodated in the cavity of the housing such that the electric wire is drawn out of the cavity and into the wire bending space;

a rubber plug installed on portions of said electric wire extending from said cavity, through said wire bending space and into said groove, portions of said rubber plug in said groove being dimensioned for sealing engagement with portions of said interconnected wall having the groove, said wire and said rubber plug being bent substantially through a right angle in said wire bending space;

a cover installed on said rear side of said housing, said cover covering said wire bending space and portions of said electric wire and said rubber plug in said wire bending space; and a sealing member between said cover and said housing for sealing gaps and for urging said rubber plug and said wire into said groove and for sealing between said cover and said rubber plug at said groove.

2. A connector according to claim 1, said rubber plug is fixed to the rear end of the terminal fixture.

3. A connector according to claim 1, wherein said sealing member is unitarily formed from a deformable gel.

4. A connector according to claim 3, wherein the sealing member has at least one aperture formed therethrough, said cover having a holder portion dimensioned and configured for passing through the aperture of the sealing member and retaining said sealing member on said cover, said holding portion further being dimensioned and configured for engaging portions of said rubber plug and holding said rubber plug and said wire in a bent orientation in said wire bending space.

5. A connector according to claim 4, wherein the holding portion is substantially hooked shaped for facilitating retention of said sealing member to said cover.

6. An electrical connector comprising:

a plurality of elongate bendable wires, each said wire having an end, a conductive core extending from said end and an insulation layer surrounding at least portions of said wire spaced from said end;

a plurality of rubber plugs mounted respectively over portions of said insulation layer of each said wire in proximity to the end thereof, each said rubber plug being dimensioned for sealing engagement with said insulation layer of the respective wire and having at least a portion that is bendable with said wire;

a plurality of terminal fixtures, each said terminal fixture having a rear end connected with the conductive core of one said wire and having a front end configured for connection with a terminal of a mating connector;

a housing with opposite front and rear sides, a wire bending space defined by a plurality of interconnected walls extending forwardly from the rear side, a plurality of cavities extending through the housing and being open at both the front side and the wire bending space of the housing, the terminals being mounted respectively in the cavities of the housing, such that the respective wires extend from the rear side of the housing, the rear side of the housing including a plurality of plug receiving grooves extending through one of the interconnected walls and aligned normal to the respective cavities, the wires and the plugs being bent in the wire bending space such that portions of said rubber plugs are in sealed engagement with portions of the grooves;

a cover installed on said rear side of said housing for covering the wire bending space and said grooves at said rear side of said housing; and a sealing member disposed adjacent said cover, said sealing member sealingly engaging portions of said cover, said housing and said rubber plugs and urging said rubber plugs tightly against said grooves of said housing.

7. A connector according to claim 6, wherein said sealing member is a plate of a deformable gel material.

8. A connector according to claim 7, wherein the sealing member has at least one aperture formed therethrough, and wherein the cover has at least one holding portion extending therefrom and dimensioned for engaging said sealing member adjacent said aperture, the holding portion having an end engaged against the rubber plugs for retaining the rubber plugs and the wires in the respective grooves.

9. An electrical connector for accommodating a plurality of terminal fixtures, each said terminal fixture having an elongate bendable wire connected thereto and having a rubber plug mounted to the terminal fixture and surrounding portions of the elongate bendable wire extending from the terminal fixture, at least a portion of each said rubber plug adjacent the respective terminal fixture being bendable with the respective wire, said electrical connector comprising:

a housing with opposite front and rear sides, a wire bending space defined by a plurality of interconnected walls extending forwardly from the rear side, a plurality of substantially parallel cavities extending through the housing and being open at both the front side and the wire bending space of the housing, each said cavity being dimensioned and configured for accommodating one said terminal fixture therein such that the respective bendable wire and the respective rubber plug is extendable rearwardly from the respective cavity and into the wire bending space, the rear side of the housing including a plurality of plug receiving portions extending through one of the interconnected walls and aligned angularly from the respective cavities, each said plug receiving portion being dimensioned and configured for receiving a portion of one said plug therein;

a cover releasably engaged on the rear side of the housing, the cover being dimensioned and configured for substantially covering the wire bending space and the plug receiving portions at the rear side of said housing, the cover having a plurality of holding portions extending forwardly into the wire bending space for holding the wire and portions of the rubber plug in a bent condition in the wire bending space and in the respective plug receiving portions; and a sealing member formed from a gel and mounted on the projections of said cover, said sealing member being dimensioned and configured for sealed engagement between said cover and said housing and for sealingly engaging said rubber plugs when said terminal fixtures are mounted in said respective cavities of said housing.

10. A connector according to claim 9, wherein said plug receiving portions are aligned substantially perpendicular to the respective cavities.

11. A connector according to claim 9, wherein said sealing member being formed with a plurality of holding portions disposed and configured for mounting on said holding portions of said cover for accurately positioning said sealing member and facilitating alignment of said sealing member during mounting of said cover onto said housing.

12. An electrical connector according to claim 11 wherein said holding portions have enlarged ends for facilitating retention of said sealing member on said cover.

* * * * *